United States Patent [19]

Parker

[11] Patent Number: 4,628,650

[45] Date of Patent: Dec. 16, 1986

[54] STRUCTURAL INSULATED PANEL SYSTEM

[76] Inventor: Bert A. Parker, 8708 Morrell, Independence, Mo. 64053

[21] Appl. No.: 774,224

[22] Filed: Sep. 9, 1985

[51] Int. Cl.[4] ..... E04B 1/00

[52] U.S. Cl. ..... 52/265; 52/269; 52/285; 52/309.9

[58] Field of Search ..... 52/309.9, 309.11, 281, 52/285, 265, 262, 271, 267, 268, 269

[56] References Cited

U.S. PATENT DOCUMENTS

| | | | |
|---|---|---|---|
| 2,568,133 | 9/1951 | Swisher | 52/285 |
| 2,961,478 | 11/1960 | Burns . | |
| 3,113,401 | 12/1963 | Rose . | |
| 3,133,322 | 5/1964 | Douglas . | |
| 3,336,710 | 8/1967 | Raynes . | |
| 3,462,897 | 8/1969 | Weinrott | 52/285 |
| 3,665,662 | 5/1972 | Timbrook | 52/281 |
| 3,949,529 | 3/1976 | Porter | 52/309.9 |
| 3,991,252 | 11/1976 | Kolakowski | 52/309.9 |
| 4,114,333 | 9/1978 | Jones et al. . | |
| 4,147,004 | 4/1979 | Day | 52/309.11 |
| 4,163,349 | 8/1979 | Smith . | |
| 4,269,005 | 5/1981 | Timmons . | |
| 4,373,313 | 2/1983 | Nash, Jr. . | |
| 4,441,293 | 4/1984 | McQueen et al. . | |
| 4,443,988 | 4/1984 | Coutu, Sr. . | |

FOREIGN PATENT DOCUMENTS

| | | | |
|---|---|---|---|
| 12139 | 5/1979 | Japan | 52/309.9 |

OTHER PUBLICATIONS

The Foam Plastics of New England advertising brochure.
The Atlas Lenap System advertising brochure.
The Delta Industries, Inc. advertising brochure.
The Energy Conserving Homes, Inc. advertising brochure.
J-Deck, Inc. Building Systems advertising brochure.
K & C Insulation Supply, Inc. advertising material.
Homosote advertising material, 1985.

*Primary Examiner*—Henry E. Raduazo
*Attorney, Agent, or Firm*—Litman, Day & McMahon

[57] ABSTRACT

A structural insulated panel system including individual panels for forming the floor, walls and roof of a structure. Each panel has an insulative rigid foam core with a rigid foam layer having an overhang extending outwardly beyond the edges of the core. Interior sheathing is placed over the core layer. Exterior sheathing is placed over the outer surface of the core and has an overhang which extends slightly beyond the core edges. Channels are formed around the core edges and receive plates at the top and bottom and transition studs at the side edges. When a structure is assembled with the panels, transition members are placed in the channels along the side edges and are overlapped by the foam layer overhangs and the sheathing overhangs to effectively seal and enclose the structure.

1 Claim, 6 Drawing Figures

STRUCTURAL INSULATED PANEL SYSTEM

BACKGROUND OF THE INVENTION

1. Field of the Invention

The present invention relates generally to building structures, and in particular to a structural insulated panel system therefor.

2. Description of the Prior Art

In the construction of various types of buildings, the walls, roofs, ceilings and floors thereof typically support both live (occupant) and dead (structure) loads in a structural capacity and also thermally insulate the space enclosed thereby. Heretofore, a variety of different construction techniques have been devised for combining these functions.

For example, conventional frame construction is widely employed in residential and other types of construction. Typically, a wood frame for the structure is constructed with load-bearing walls comprising studs, top and bottom plates and headers over the openings. Floor and ceiling joists span between the walls. During or after the framing stage, sheathing and/or siding is typically applied to the exteriors of the walls. The walls are then insulated with, for example, fiberglass insulation for controlling thermal conduction therethrough. Insulation is also typically placed between the ceiling joists or roof rafters and between the floor joists over unheated areas. The wall interiors generally comprise a layer of gypsum board, paneling or the like.

Although widely used, the aforementioned frame construction techniques have several drawbacks. For example, they tend to be relatively labor-intensive with most of the assembly taking place on the job site. Weather conditions often delay and hamper such projects and can damage the construction materials before the structure can be enclosed and made weathertight. Furthermore, difficulties can be encountered in controlling quality on the job site, particularly under adverse weather conditions. Yet another disadvantage is that conventional wood frame construction often produces structures which are relatively inefficient to heat and cool. One source of heat loss is the structural studs themselves, which provide thermal bridges for conducting heat between the exterior ambient atmosphere and the enclosed space.

In order to overcome some of the aforementioned disadvantages with site-built frame construction, wall panel systems have heretofore been devised which provide wall panels which are both structural and thermally insulated. For example, the Douglas U.S. Pat. No. 3,133,322 and the Smith U.S. Pat. No. 4,163,349 disclose prefabricated, insulated building panels. However, the panels disclosed in these patents include areas with materials which are not particularly effective as thermal insulation and which thus permit undesired heat gain and loss.

Heretofore, there has not been available a structural insulated panel system with the advantages and features of the present invention.

SUMMARY OF THE INVENTION

In the practice of the present invention, a structural insulated panel system is provided which includes floor, wall and roof panels for enclosing a building. Each panel includes a foam core with a layer having an overhang projecting from the foam core edges. Interior sheathing is placed over the foam core layer and exterior sheathing, also having an overhang, is attached to an outer surface of the core. The panel cores also have longitudinally extending intermediate channels for receiving intermediate joists, studs or rafters. In constructing a building with the panel system, transition members—i.e. joists, studs or rafters—are placed in transition channels formed by the overhangs along respective foam core side edges. The overhangs abut each other over the transition members so that an effective seal between adjacent panels is provided. Wall panels for corners, windows, doors and gable ends are provided so that a variety of different building configurations may be constructed with the panel system.

OBJECTS OF THE INVENTION

The principal objects of the present invention are: to provide a structural insulated panel system; to provide such a panel system which may be used to construct buildings; to provide such a panel system which has a relatively high thermal insulative value; to provide such a panel system which provides an effective infiltration seal; to provide a panel which may be utilized in appropriate embodiments as wall, ceiling, roof and floor panels; to provide such a panel which greatly simplifies construction of a structure therewith; to provide such a panel which employs common wood framing members; to provide such a panel which utilizes expanded polystyrene or polyurethane foam for insulation; to provide such a panel which may be readily adapted to accommodate various sizes and shapes of fenestration; to provide such a panel which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
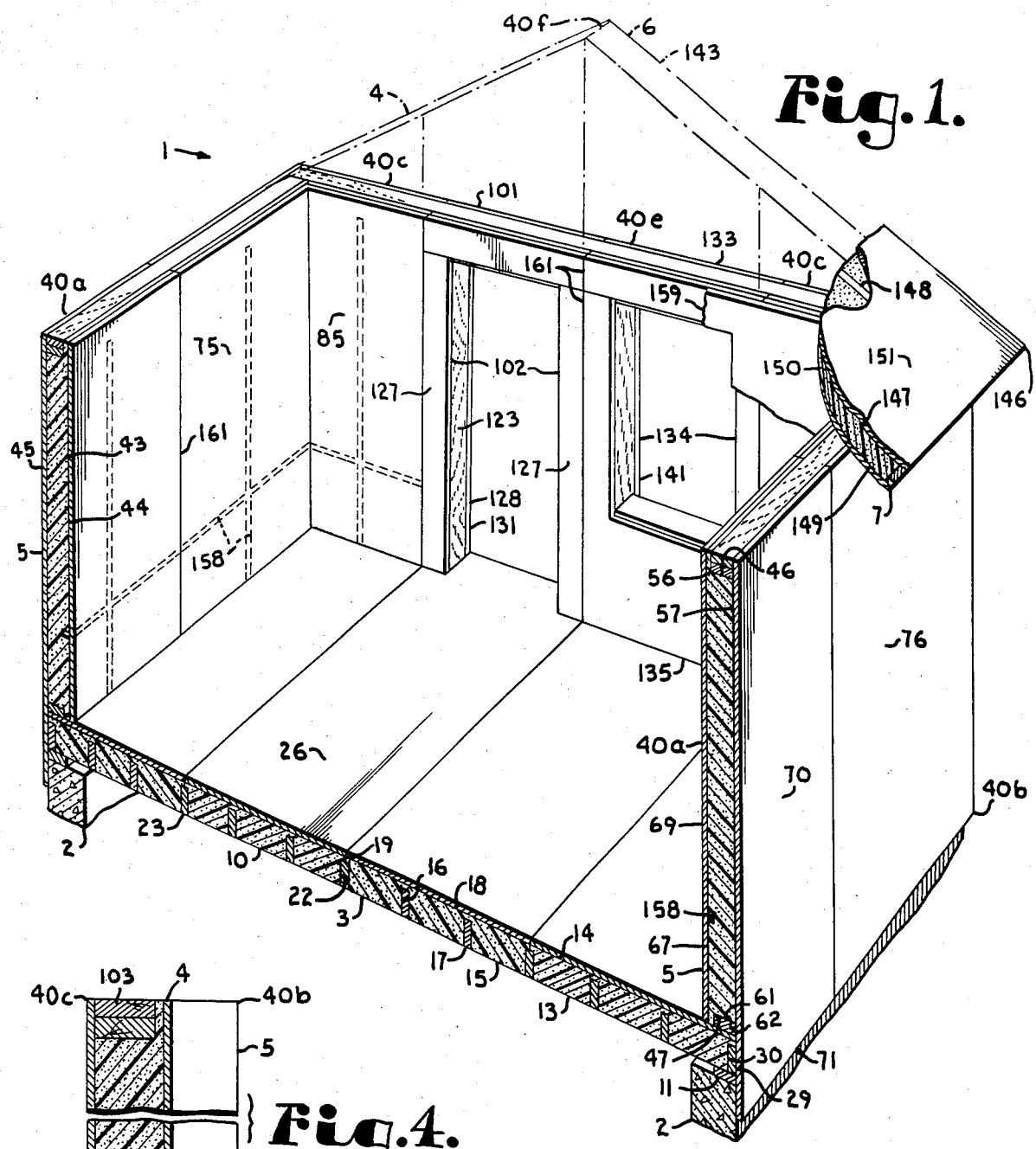
FIG. 1 is a perspective view of a building with a panel system embodying the present invention.
Figure 4:
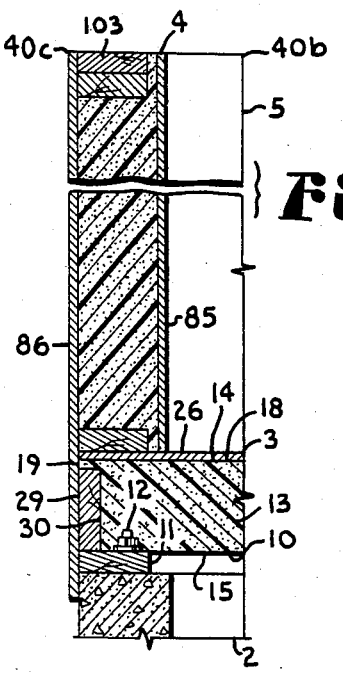
FIG. 4 is an enlarged, vertical cross-section taken generally along line 4—4 in FIG. 2.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a building with a structural insulated panel system embodying the present invention. Without limitation on the generality of useful buildings that may embody the present invention, the building 1 might comprise, for example, a house, room addition, garage or the like. The building 1 includes foundation walls 2 supporting a floor structure 3 upon which are mounted end and side walls 4 and 5 respectively. A gable end 6 extends upwardly from the end wall 4 and together with the side walls 5, supports a roof 7.

The panel system of the present invention is designed so that the individual panels ordinarily have nominal dimensions of four feet by eight feet, with variations as described hereinafter to accommodate various conditions which are likely to be encountered in construction.

The floor 3 comprises floor panels 10 supported by a plate 11 anchored to the foundation wall 2 by suitable anchor bolts 12. Each floor panel 10 includes an insulative rigid foam core 13 comprising, for example, expanded polystyrene (EPS) with upper and lower surfaces 14, 15. However, other insulative materials having suitable characteristics, such as expanded polyurethane or extruded foam could be successfully employed with the present invention.

The foam core 13 has an overall thickness of eight inches and includes a pair of longitudinally extending intermediate channels 16 each having dimensions of one and one-half inches by seven and one-half inches for receiving a two-by-eight intermediate joist 17 with actual cross-sectional dimensions of one and one-half inches by seven and one-half inches. The remaining one-half inch of thickness of the core 13 comprises a continuous foam layer 18 on top of the joists 17. The foam layer 18 has three-quarter inch overhangs 19 along each side thereof whereby floor transition channels 22 are formed and receive transition joists 23 between adjacent floor panels 10. Underlayment 26 comprising, for example, wood chipboard is applied to the foam core upper surface 14 over the continuous foam layer 18, including the overhangs 27 of the latter. The floor panels 10 are constructed as necessary to accommodate the conditions encountered at the edges of the floor 3. For example, a rim joist 29 encircles the floor 3 and is received in a full thickness rim joist channel 30 at the outer edges of the floor 3.

The building walls 4 and 5 comprise an intermediate wall panel **40*a*, a long corner wall panel 40*b*, a short corner wall panel 40*c*, a door wall panel 40*d*, a window wall panel 40*e* and a gable wall panel 40*f***. It will be appreciated that the different types of wall panels may be combined as necessary to form structures with desired configurations.

The intermediate wall panel **40*a* includes a foam core 43 with inner and outer surfaces 44, 45. The core 43 has an overall thickness of six inches. The core 40*a* is bounded by upper, lower and side edges 46, 47 and 48. An intermediate channel 52 extends longitudinally between the core upper and lower edges 46, 47 approximatley halfway between and parallel to the panel side edges 48. The intermediate channel 52 has cross-sectional dimensions of one and one-half inches by five and one-half inches to receive a two-by-six intermediate stud 53**.

A pair of two-by-six's form a double top plate 56 received in a top plate channel 57 extending along the core upper edge 46. Another two-by-six forms a bottom plate 61 located in a bottom plate channel 62 extending along the core lower edge 47. The top plate channel 57 has cross-sectional dimensions of 3 inches by 5½ inches. The bottom plate channel 62 has cross-sectional dimensions of 1½ inches by 5½ inches. A pair of wall transition channels 65 extend along the core side edges 48 and each has cross-sectional dimensions of approximately ¾ of an inch by 5½ inches. The foam core 43 includes a ½ inch thick layer 67 at its inner surface 44. The layer 67 includes an overhang 68 projecting from the core edges 46, 47 and 48, 3 inches, 1½ inches and ¾ inch respectively.

Interior sheathing 69 comprising, for example, wood chipboard or the like is applied to the core inner surface 44 over the foam layer 67. Exterior sheathing or siding 70 comprising, for example, exterior grade plywood, is applied to the core outer surface 45. The exterior siding 70 includes an overhang 71 extending beyond the core upper and side edges 46, 48, 3 inches and ¾ inch respectively, and beyond the core lower edge 47 a sufficient distance to cover part of the foundation wall 2 as shown in FIG. 1. The channels 57, 62 and 65 are defined by respective core edges 46, 47, 48 and the overhangs 68, 71.

Figure 3:
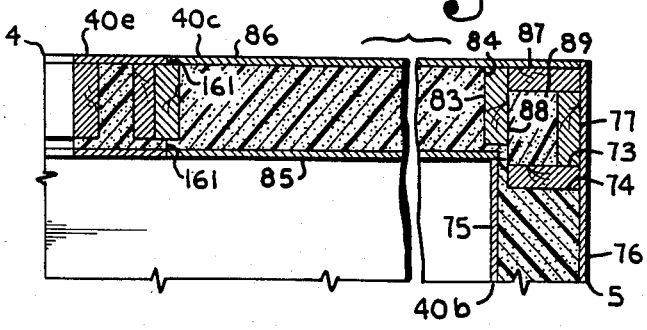
FIG. 3 is an enlarged, horizontal cross-section taken generally along line 3—3 in FIG. 2 and showing a corner of the building.
Figure 2:
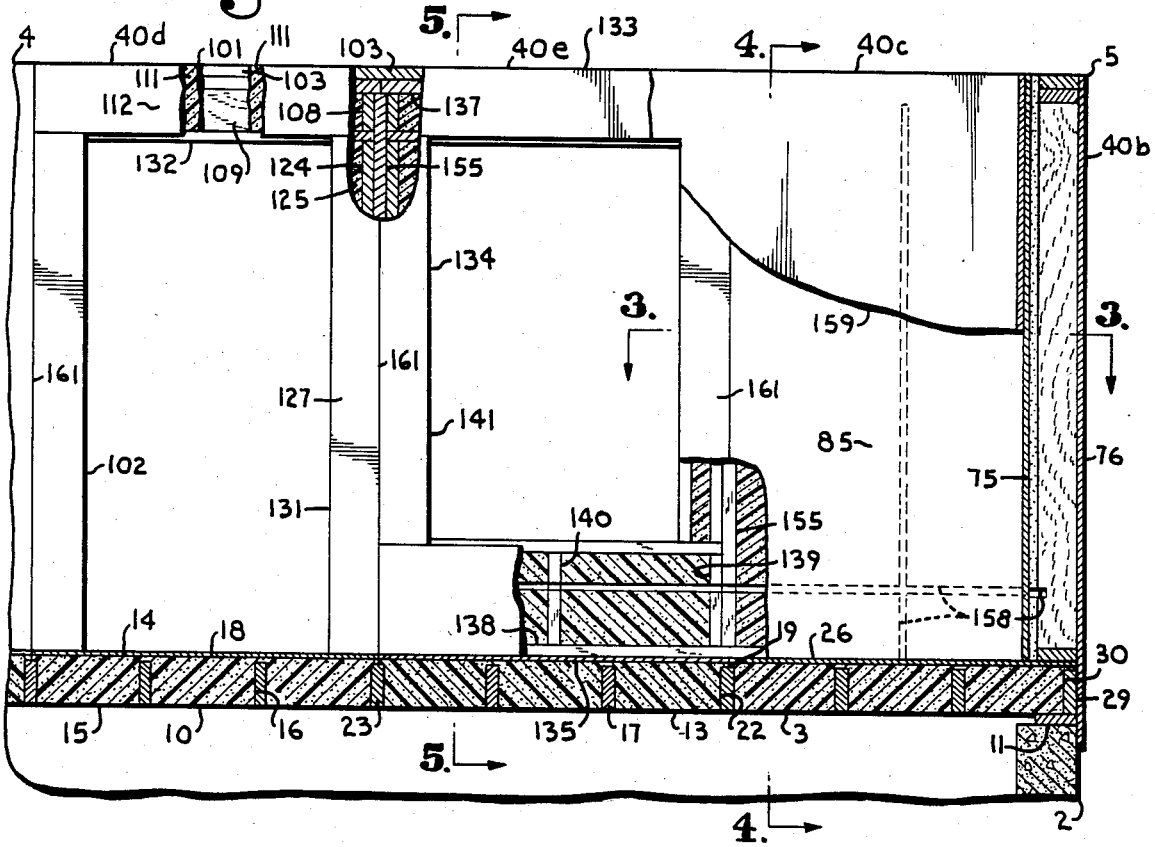
FIG. 2 is an elevation of the building.
Figure 6:
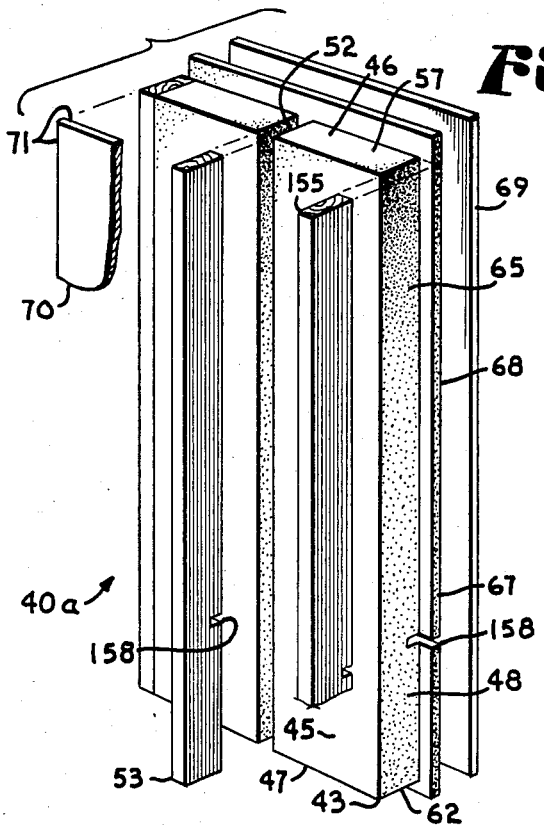
FIG. 6 is a perspective of a panel showing the construction details thereof.
Figure 5:
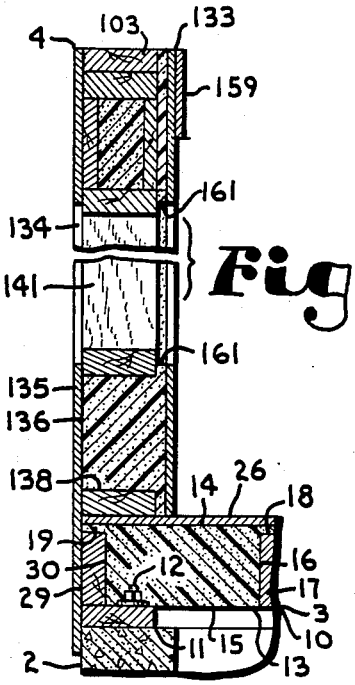
FIG. 5 is an enlarged, vertical cross-section taken generally along line 5—5 in FIG. 2.

The long corner wall panel **40*b* includes an edge stud 73 received in an edge stud channel 74. Interior sheathing 75 extends slightly beyond the edge stud 73 and exterior sheathing or siding 76 extends substantially beyond the edge stud 73. A corner stud 77 is attached to the inside face of the exterior sheathing 76 and to the edge stud 73 as shown in FIG. 3. The exterior sheathing 76 also extends slightly beyond the corner stud 77. The long corner wall panel 40*b* is otherwise substantially similar to the intermediate wall panel 40*a***.

The short corner wall panel **40*c* includes an edge stud 83 received in an edge stud channel 84 in substantially flush relationship with an adjacent side edge of interior sheathing 85. Exterior sheathing or siding 86 extends approximately 5½ inches beyond the outer face of the edge stud 83. A corner stud 87 is placed against the inside of the exterior sheathing 86 and against the edge stud 83. With the corner panels 40*b* and 40*c* connected together as shown in FIG. 3, a vertical passage 88 is formed between the edge studs 73, 83 and the corner studs 77, 87. The passage 88 is filled by a foam corner core 89**.

The door wall panel **40*d* includes a door transom section 101 and a pair of upstanding door jamb sections 102. The transom section 101 includes a pair of top plates 103, a pair of spacers 108 and a pair of headers 109. A door transom core (not shown) is placed between the headers 109 and a foam layer 111 with an overhang 114 is placed over the inside header 110**.

Door transom section interior sheathing 112 is attached to the foam layer 111 and exterior sheathing or siding 113 is attached to the outer face of the door transom section 101 over the plates 103, the spacers 108 and the outside header 110. The overhang 114 of the foam layer 111, the interior sheathing 112 and the exterior siding 113 all extend approximately ¾ of an inch past the spacers 108.

Each door jamb section 102 includes a bottom plate 122, inside and outside cripples 123, 124 and a jamb foam core 125 with a jamb foam layer 126. The foam layer 126 includes an overhang 121 extending from the transom section upper end and the outside cripple 124. Interior sheathing 127 is placed over the foam layer 126 and exterior sheathing or siding 128 is placed on the outside of the jamb section 102 over the plate 122 and the cripples 123, 124. A door opening 131 is defined by the door transom and jamb sections 101, 102. The door transom and jamb sections 101, 102 are interconnected by a door transition plate 132 received in respective channels formed in the sections 101, 102.

The window wall panel **40*e* is constructed in much the same manner as the door wall panel 40*d* with a window upper transom section 133 and a pair of window jamb sections 134. A lower transom section 135 extends transversely across the window wall panel 40*e* and includes a foam core 136, top and bottom plates 137, edge spacers 139 and an intermediate spacer 140. A window opening 141 is defined by the window transom sections 133, 135 and the window jamb sections 134**.

The gable wall sections **40*f* are constructed in a substantially similar manner to the intermediate wall sections 40*a* except that they are provided with angled upper edges 143 and are sized as required to provide a gable end wall 6** of the desired configuration.

The roof 7 of the building 1 shown provides a sloping or vaulted ceiling when viewed from the inside. The roof 7 comprises roof sections 146 each having a foam core 147, rafters 148, a foam layer 149 under the rafters 148, interior sheathing 150 applied to the foam layer 149 and exterior sheathing 151 applied over the rafters 148.

Although the building 1 has been shown with a particular configuration and combination of elements for purposes of disclosing the present invention, it will be appreciated that structures of various configurations and sizes can be constructed from the panel system comprising the present invention. The panels are based on a four feet by eight feet module, but modules of different sizes could be employed and the panel dimensions could be varied for non-modular construction. The door and window openings 131, 141 cam be sized to accommodate various door and window units as required.

In constructing the building 1, the floor 3 is first placed on the foundation walls 2. Transition joists 23 are placed in the floor transition channels 22 to interconnect the floor panels 10. The wall panels **40*a–f* are then erected on the floor 3. The door and window wall panels 40*d* and 40*e* are manufactured and shipped with their respective transom and jamb sections separate for assembly at the job site. The wall sections 40*a–f* are interconnected by placing transition studs 155 in respective wall transition channels 65. The roof panels 146** are then attached to and supported by the wall sections. The various panels are preferably joined in a conventional manner by nailing. Caulking and suitable adhesives may be also applied at the respective joints.

At this point, the building 1 would be complete to a "rough-in" and insulated stage. Wiring (not shown) is then run through electrical wiring channels 158 in the foam cores of the wall sections **40*a–f*. Alternatively, the wall sections 40*a–f*** may be prewired.

Gypsum board 159 is then applied over the interior sheathing of the wall panels **40*a–f* and the roof panels 146 and finished in the normal manner. Door and window units (not shown) are placed in respective openings 131, 141. Roofing material (not shown) is applied to the exterior sheathing 151 of the roof panels 146 and floor covering is applied to the underlayment 26 of the floor panels 10. The building 1** may otherwise be finished and completed in the normal manner.

The building 1 has numerous advantages over buildings constructed using more conventional techniques, and in particular with respect to conventional on-site frame construction. First of all, the building 1 is relatively energy efficient, particularly as compared to most buildings constructed according to conventional techniques. With the wall thicknesses described hereinbefore and with 7/16 inch thick gypsum board 159, the R factor for the walls is estimated at 26. Furthermore, the foam layer overhangs which overlay the various structural members are butted at respective butt joints 161 so that a continuous layer of ½ inch thick foam surrounds the space enclosed by the building 1. The butt joints 161 of the foam layers are designed to center over structural members so that infiltration therethrough is blocked.

The foam insulation material, in addition to its thermally insulative properties, provides an effective vapor barrier with moisture retention of approximately 2%. Therefore, the foil or polyvinyl vapor barrier which is often applied in conventional construction is not required. Energy loss through the building corners is effectively prevented by the foam corner core 89. With the respective joints between the panels properly caulked and with low-infiltration door and window units, the building 1 will experience very low air infiltration. Thus, it is anticipated that an air-to-air exchanger may be required to provide fresh air in the space since the relatively frequent air changes which occur in most conventional structures will not be encountered in the building 1.

Yet another advantage of the building 1 constructed according to the present invention is that construction time may be shortened since the various panels are substantially preassembled prior to shipment to the job site. Construction costs may be lessened with respect to conventional construction because of the mass production techniques which can be utilized to manufacture the panels and because the construction time may be shortened by their use. The building owner will achieve further savings because of reduced energy costs for heating and cooling the building 1.

It is understood that the dimensions of the various components called for herein are exemplary only. For example, nominal dimensions are commonly used in the art to designate lumber; e.g. two-by-fours, two-by-sixes, etc. However, the actual dimensions of a two-by-six, for example, are approximately 1½ inches by 5½ inches. Thus, the various dimensions indicated above are approximations that may be altered without departing from the spirit of the invention. The layers 18, 67, 111, 126 and 149 may be either integrally formed with their respective cores or may be formed separately and attached thereto.

It is to be understood that while certain forms of the present invention have been illustrated and described herein, it is not to be limited to the specific forms or arrangement of parts described and shown.

What is claimed and desired to be secured by Letters Patent is as follows:

1. A building, which comprises:

(a) a plurality of floor panels each including:

(1) an insulative core with upper and lower surfaces, longitudinally-extending opposite side edges, a longitudinally-extending intermediate channel and a layer at said upper surface having an overhang extending beyond said side edges;

(2) underlayment placed on said core upper surface;

(3) at least a pair of said floor panels adjoining with respective side edges in opposed relation whereby a transition channel is formed between said side edges;

(b) a transition joist received in said floor panel transition channel;

(c) a pair of corner wall panels each having:

(1) a core with inner and outer surfaces; upper, lower and side edges; and a layer at said inner surface with an overhang extending beyond said core edges; and and intermediate channel extending in spaced relation between and parallel to said side edges;

(2) an intermediate stud located in said intermediate channel;

(3) an interior sheathing member attached to said core inner surface over said layer;

(4) an exterior sheathing member attached to said core outer surface and having an overhang extending beyond said core edges;

(5) a top plate channel formed by said core upper edge, said core layer overhang and said outer sheathing member overhang;

(6) a top plate positioned in said top plate channel;

(7) a bottom plate channel formed by said core lower edge, said core layer overhang and said outer sheathing member overhang;

(8) a bottom plate positioned in said bottom plate channel and attached to said underlayment;

(9) a wall transition channel formed by a respective core side edge, core layer overhang and outer sheathing member overhang;

(10) an edge stud channel formed by the other of said core side edges, said core layer overhang and said outer sheathing overhang;

(11) an edge stud positioned in said edge stud channel; and

(12) a corner stud attached to said edge stud and said outer sheathing member overhang;

(d) said edge studs and said corner studs forming a vertical corner passage with said corner wall panels being connected together;

(e) a corner core member extending through said corner passage;

(f) a plurality of wall panels each having:

(1) a core with inner and outer surfaces; upper, lower and side edges; and a layer at said inner surface and having an overhang extending beyond said core edges;

(2) an interior sheathing member applied to said core inner surface over said layer;

(3) an exterior sheathing member applied to said core outer surface and having an overhang extending beyond said core edges;

(4) a top plate channel formed by said core upper edge, said core layer overhang and said outer sheathing member overhang;

(5) a top plate positioned in said top plate channel;

(6) a bottom plate channel formed by said core lower edge, said core layer overhang and said outer sheathing member overhang;

(7) a bottom plate positioned in said bottom plate channel; and (8) a pair of wall transition channels each formed by a respective core side edge, core layer overhang and outer sheathing member overhang;

(g) a plurality of said wall panels being attached in adjoining relationship with said transition channels in opposed relationship and respective said core layers and outer sheathing members in abutting relationship and forming butt joints therebetween;

(h) a plurality of transition studs each positioned in a respective pair of opposing transition channels;

(i) at least one of said panels comprising a door panel with a transom section and a pair of jamb sections, said sections defining a door opening;

(j) at least one of said panels comprising a window panel with upper and lower transom sections and a pair of jamb sections, said sections defining a window opening;

(k) a plurality of roof panels each including:

(1) an insulative core with upper and lower surfaces, a pair of side edges and a layer at said lower surface and having an overhang extending beyond said side edges;

(2) an upper sheathing member attached to said upper core surface and having an overhang extending beyond said core side edges;

(3) a lower sheathing member applied to said core lower surface over said layer;

(4) a pair of roof panel transition channels formed by said core side edges, said layer overhang and said upper sheathing member overhang;

(l) a pair of said roof panels positioned together in adjoining relation with respective transition channels thereof positioned in opposed relation: and (m) a transition rafter positioned in said opposed transition channels.

* * * * *